US007442886B2

(12) United States Patent
Hashida

(10) Patent No.: US 7,442,886 B2
(45) Date of Patent: Oct. 28, 2008

(54) MULTI-DIRECTIONAL INPUT UNIT

(75) Inventor: Junji Hashida, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 4 days.

(21) Appl. No.: 11/682,154

(22) Filed: Mar. 5, 2007

(65) Prior Publication Data

US 2007/0209919 A1 Sep. 13, 2007

(30) Foreign Application Priority Data

Mar. 7, 2006 (JP) ..... 2006-061061
Mar. 7, 2006 (JP) ..... 2006-061062

(51) Int. Cl.
*H01H 13/70* (2006.01)
*H01H 25/00* (2006.01)
*H01H 25/04* (2006.01)

(52) U.S. Cl. ..... 200/5 R; 200/6 A

(58) Field of Classification Search ..... 200/5 R
See application file for complete search history.

(56) References Cited

U.S. PATENT DOCUMENTS 6,437,682 B1 * 8/2002 Vance ..... 338/185
7,094,979 B2 * 8/2006 Kurokawa et al. ..... 200/5 R
7,288,732 B2 * 10/2007 Hashida ..... 200/5 A
7,297,883 B2 * 11/2007 Rochon et al. ..... 200/5 R

FOREIGN PATENT DOCUMENTS

JP 2001-345031 12/2001

* cited by examiner

*Primary Examiner*—Elvin Enad
*Assistant Examiner*—Lheiren Mae A Anglo
(74) *Attorney, Agent, or Firm*—Brinks Hofer Gilson & Lione

(57) ABSTRACT

The present invention relates to a multi-directional input unit. A thin plate-type operating member having an elastic force is fixed to any one of first and second keytops, and the first and second keytops are elastically urged to a predetermined height whereby a reliable click is generated. A portion of an outer peripheral portion of an operating member is mounted on a fixing plate, a first operating portion or a second operating portion is fixed to either the first or second keytops, the first and second keytops are elastically urged to a predetermined height from the fixing plate, and when either of the first and second keytop are pressed down, either of the dome-shaped first and second keytops are inverted, whereby a switch portion is operated.

16 Claims, 5 Drawing Sheets

MULTI-DIRECTIONAL INPUT UNIT

This application claims the benefit of priority under 35 U.S.C. § 119 to Japanese Patent Application No. 2006-061061, filed Mar. 7, 2006 and 2006-061062, filed on Mar. 7, 2006, both of which are hereby incorporated by reference in its entirety.

BACKGROUND OF THE INVENTION

1. Field of the Invention

The present invention relates to a multi-directional input unit, and more particularly, to a multi-directional input unit which accepts inputs in a plurality of directions by pressing down various positions of the keytop.

2. Description of the Related Art

A known multi-directional input unit 100 show in FIG. 10 includes a circular keytop 170 fitted in a push slide 150 and disposed in an outer chassis 180, a rotary plate 132 and chassis portion 121 mounted in the push slide 150, a first switch portion 110*f* in a center portion and a second switch portions 110*b*, 110*d* in an outer peripheral portion formed in a dome shape and mounted on a switch substrate 110.

In an initial state of a horizontal operating surface 170*a* of the keytop 170, when an outer peripheral portion of the operating surface 170*a* is pressed in a direction indicated by an arrow A, as a first operation, the keytop 170 is inclined in the direction indicated by arrow A.

The push slide 150, the rotary plate 132, and the chassis portion 121 are inclined along with the inclination operation of the keytop 170, and a convex portion 121*h* in the outer peripheral portion of the chassis portion 121 presses down the dome-shaped second switch portion 110*b* with a predetermined operating force. Accordingly, the second switch portion 110*b* is activated by the pressing operation.

When the pressing force in the direction indicated be arrow A is released, the push slide 150, the rotary plate 132, the chassis portion 121, and the keytop are restored to the initial state by an elastic bias of the dome-shaped second switch portion 110*b*.

Accordingly, the second switch portion 11*b* is deactivated. When the outer peripheral portions of the operating surface 170*a* are pressed down, the keytop 170 is inclined in a respective direction, whereby a projection portion 121*h* of the chassis 121 allows the second switch portions 110*b*, 110*d* to be on.

According to the known input unit 100 shown in FIG. 11, in an initial state of the horizontal operating portion 170*a*, the center portion of the keytop 170 is pressed in a direction indicated by an arrow B. Then, the push slide 150 resists an elastic force of a slide restoring spring 140 and moves downwardly, whereby a convex portion 150*d* of the push slide 150 presses down the first switch portion 110*f* of the switch substrate 110. Accordingly, the dome-shaped the first switch portion 110*f* is inverted and toggled.

An operator feels a click accompanying the inversion of the first switch portion 110*f*, whereby the operator can realize that the first switch portion 110*f* is toggled.

When the pressure in the direction of arrow A of the keytop 170 is released, the keytop 170 is automatically restored in the original initial state by an elastic force of the first switch portion 110*f* and an elastic force of the slide restoring spring 140.

Accordingly, the first switch portion 110*f* is deactivated.

[Patent Document 1] Japanese Unexamined Patent Application Publication No. 2001-345031

However, according to the above-mentioned known input unit 100, since the first switch is inverted and toggled by pressing down the keytop 170 against the elastic force of the slide restoring spring 140, the click felt by the user when the first switch portion 110*f* is inverted is absorbed by the slide restoring spring 140, causing the generated click to be weakened. Accordingly, it is difficult to realize whether the first switch is toggled.

In addition, in case of an input of the first switch portion 110*f* or the second switch portion 110*b*, when the pressed position on the operating surface 170*a* of the keytop 170 is not uniform and when the first switch portion 110*f* and the second switch portions 110*b*, 110*d* are operated at the same time, error inputs may occur.

SUMMARY OF THE INVENTION

The invention provides a multi-directional input unit, in which some parts of a plat operating member are biased with an elastic force fixed to either a first or second keytops, and the first and second keytops is elastically urged to a predetermined height, thereby providing an accurate click feeling.

Another advantage of the invention provides a multi-directional input unit in which a first switch portion in the center of the first switch portion and a second switch portion in an outer peripheral portion of the first switch portion can be operated independently, thereby enhancing operability.

According to a first aspect of the invention, a multi-directional input unit includes a first keytop held at a predetermined height, a ring-shaped second keytop held at the same height as the first keytop so as to surround outside of the first keytop, an operating member elastically urging the first and second keytops to a predetermined height, and a membrane switch having a plurality of switch portions operated by the operating member on the side opposite to the first and second keytops. A first operating portion elastically urging the first keytop is formed in the operating member, and a plurality of second operating portions elastically urging the second keytop is integrally formed in an outer peripheral side of the first operating portion. Portions of an outer peripheral portion of the operating member arc mounted on a fixing plate, the first or second operating portion is fixed on either the first or second keytops, the first and second keytops are elastically urged to a predetermined height from the fixing plate, and either of the dome-shaped first and second operating portions is inverted whereby the switch portion is operated when either of the first or second keytops is pressed down.

According to a second aspect of the invention, a plurality of elastically deformable connecting portions which connect the first and second operating portions may be formed in the operating member, and the first and second keytops may be elastically urged by the first and second operating portions so as to be at a predetermined height.

According to a third aspect of the invention, a fixing portion for fixing on the second keytop may be formed in the connecting portions proximate the second operating potion, and the fixing portion may be fixed on the second keytop.

According to a fourth aspect of the invention, an operating surface of the first keytop may be inserted into a fitting hole formed in the center of the second keytop whereby the first keytop is not pulled out and the operating surface of the first keytop may be elastically urged to the same height as an operating surface of the second keytop by the first operating portion of the operating member in which the fixing portion may be fixed.

According to a fifth aspect of the invention, convex portions for pressing down the dome-shaped operating surfaces of the first and second operating members may be projected to a predetermined height in the first and second keytops.

According to a sixth aspect of the invention, the fixing portion may include an attachment hole formed in a part of the connecting portion, and an attachment projection, which is fitted into the fitting hole and is capable of caulking, may be formed in the second keytop.

According to a seventh aspect of the invention, the connecting portion may be curved from the fixing portion toward the first and second operating portion.

According to an eighth aspect of the invention, the operating member may be formed of an elastic metal plate and the fixing plate may be formed of a rigid metal plate. Further, an outer peripheral portion, which connects the plurality of connecting portions and the attachment arm portion extending from the outer peripheral portion to the outside, may be formed in the operating member. Additionally, the attachment arm portion may be attached on the fixing plate whereby a movement of the operating member, except for the first and second operating portion and the connecting portion, may be limited.

According to a ninth aspect of the invention, a positioning projection for positioning the membrane switch, the operating member and a caulking portion to a location where the attachment arm of the operating member formed of a metal plate.

According to a tenth aspect of the invention, the second keytop is pressed by two differing operating forces, whereby the second keytop having first and second input operations different each other may be operated.

According to an eleventh aspect of the invention, in the membrane switch, a first switch portion may be formed in a position opposite to the first operating portion, a second switch portion may be formed in positions opposite to the second operating portion at intervals of 45° in a radial direction, and third switch portions may be formed at a predetermined interval from the second switch portion, and positioned at intervals of 90°.

According to a twelfth aspect of the invention, the second operating portion, which operates the second and third switch portions positioned at intervals of 90°, may be formed in a position opposite to the third switch portion. A third operating portion may be formed between the second operating portions adjacent each other, where the third operating portion operates the second switch portion that the second operating portion does not operate.

According to a thirteenth aspect of the invention, the first keytop is pressed down and the first operating portion is inverted so that a first input operation of the first switch portion may be performed. A predetermined press is applied to the second keytop so that a second input operation of the second switch portion may be performed through the second and third operating portion, and a pressing force greater than the predetermined pressing force is applied to the second keytop and the dome-shaped second operating portion is toggled so that a third input operation of the second switch portion may be performed.

According to a fourteenth aspect of the invention, each of the first, second, and third operating portions are connected to the narrow-width connecting portion and are integrated so that the operating member elastically may urge the first and second keytops to a predetermined height.

According to a fifteenth aspect of the invention, a part of the dome-shaped outer peripheral portion of the third operating portion is notched so that the click feeling of the third operating portion is reduced relative to the click feeling of the second operating portion.

According to a sixteenth aspect of the invention, second switch operating portions, which are extended from the dome-shaped outer peripheral portion and operate the second switch portion, may be formed in the second and third operating portions respectively and wherein third switch operating portion, which is projected from a dome-shaped crowning portion to the inside and operates the third switch portion, may be formed in the second operating portion.

According to a seventeenth aspect of the invention, a convex portion which presses down the first operating portion, may be formed in the first keytop, and a plurality of convex portions which press down the second and third operating portions, may be formed in the second keytop.

DESCRIPTION OF THE PREFERRED EMBODIMENT

Figure 1:
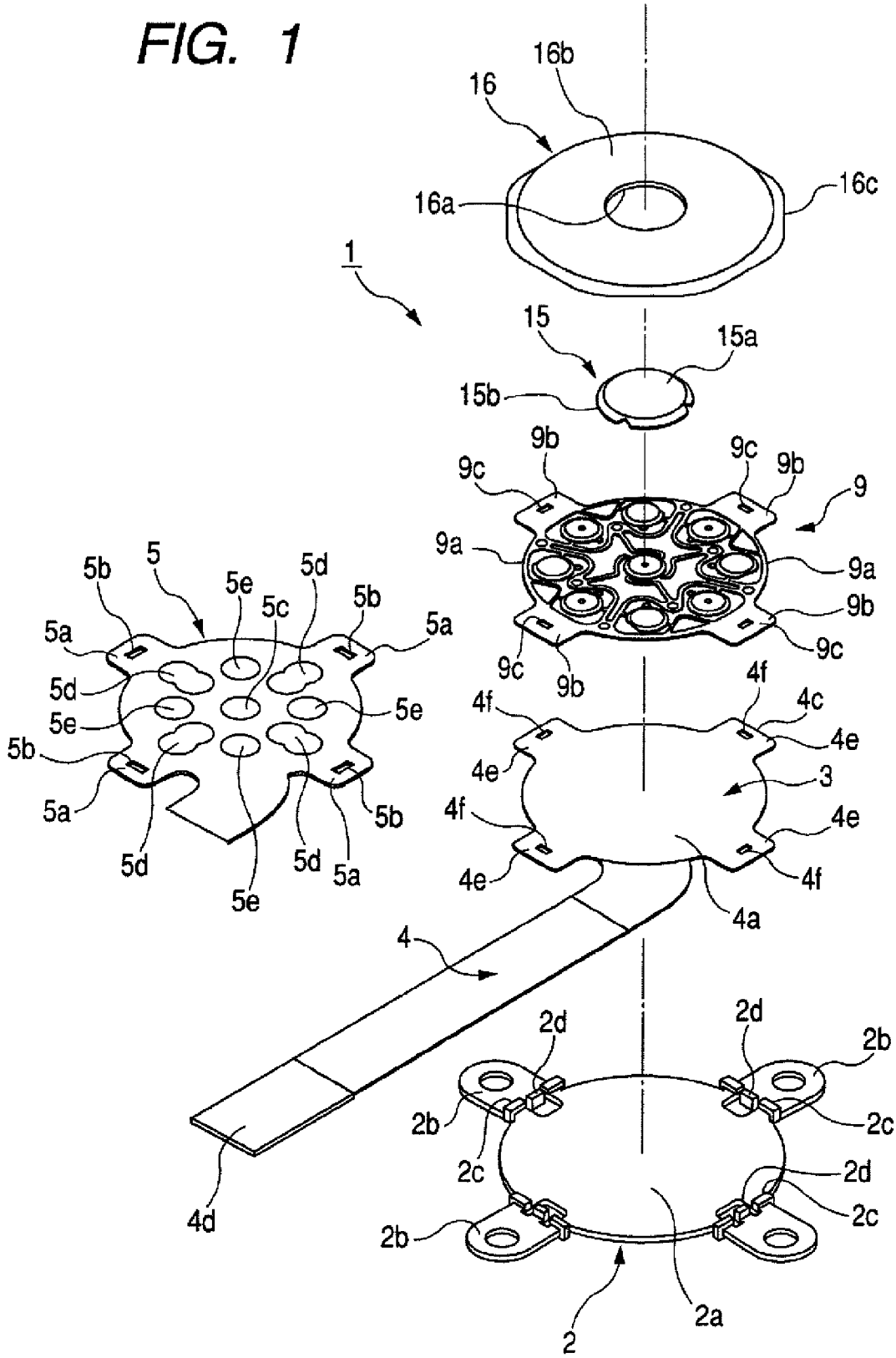
FIG. 1 is a perspective view of a multi-directional input unit of the invention.
Figure 2:
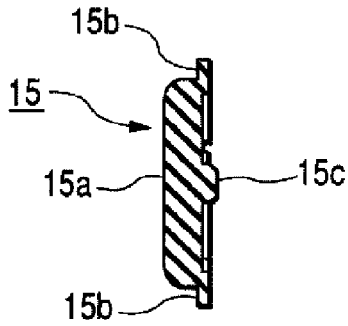
FIG. 2 is a sectional view of a first keytop.
Figure 3:
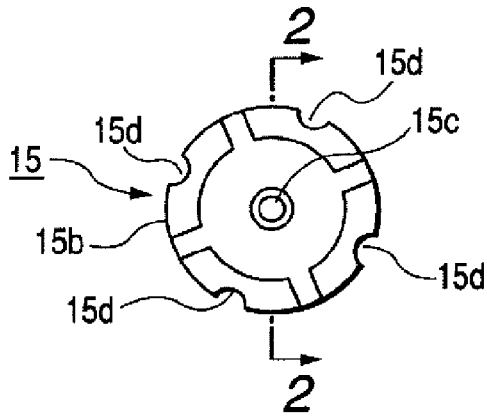
FIG. 3 is a bottom view of a first keytop.
Figure 4:
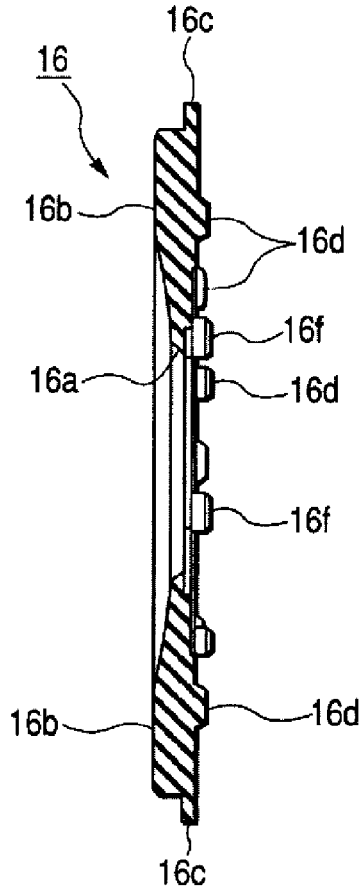
FIG. 4 is a sectional view of a second keytop.
Figure 5:
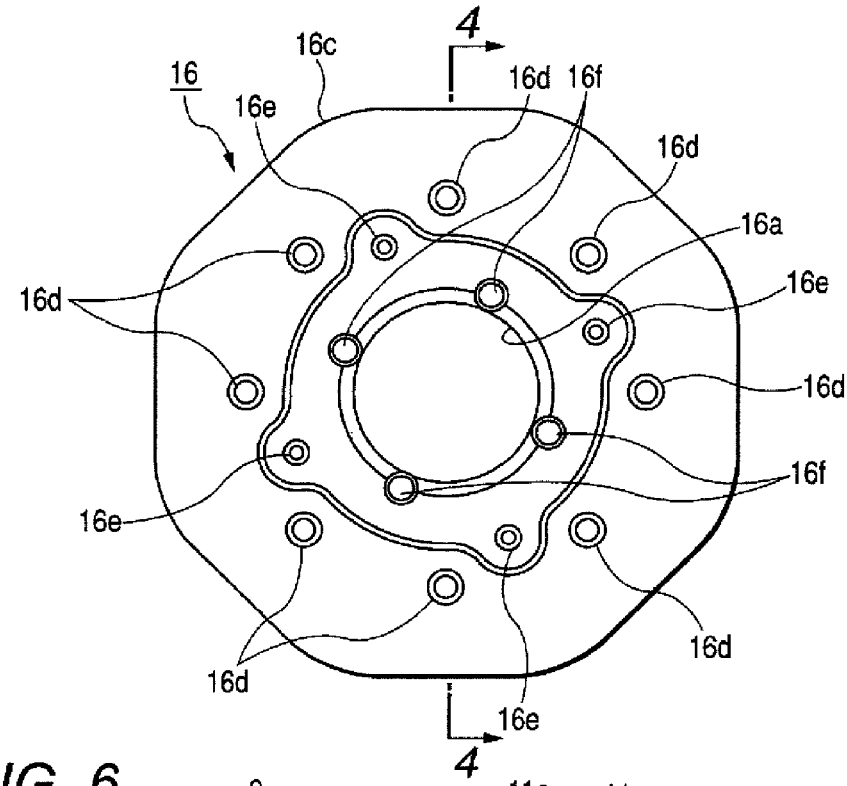
FIG. 5 is a bottom view of a second keytop.
Figure 6:
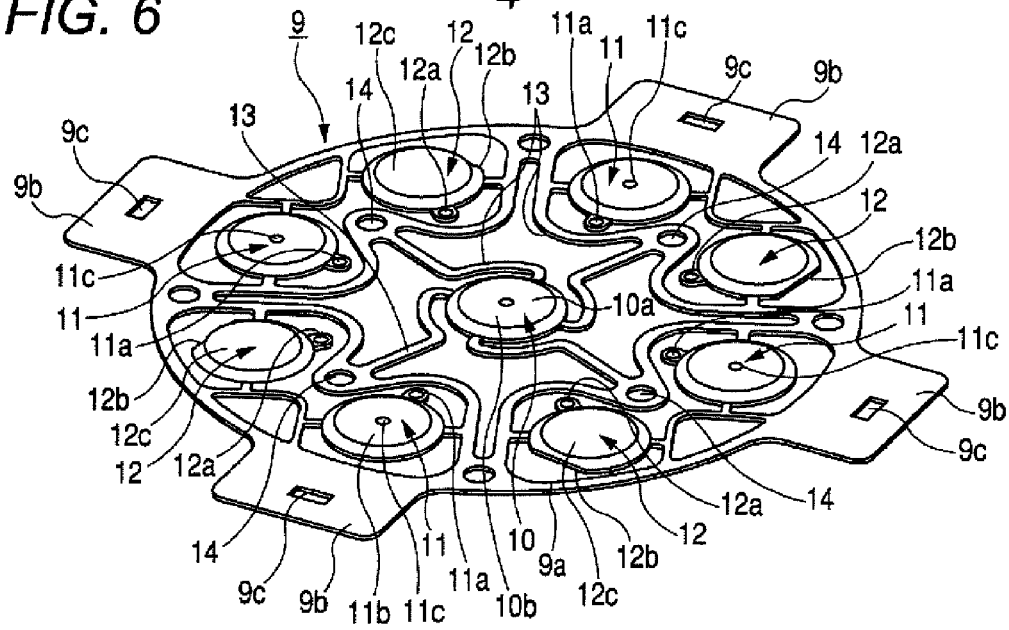
FIG. 6 is a perspective view of an operating member.
Figure 7:
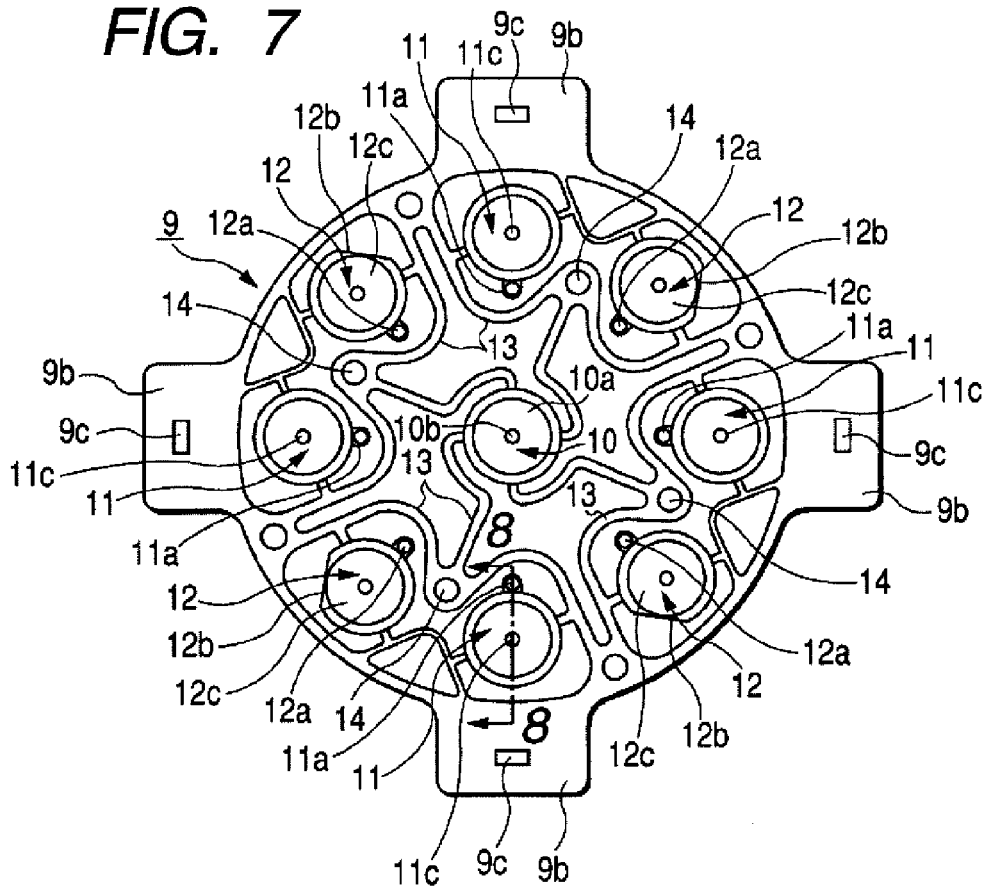
FIG. 7 is a top view of an operating member.
Figure 8:
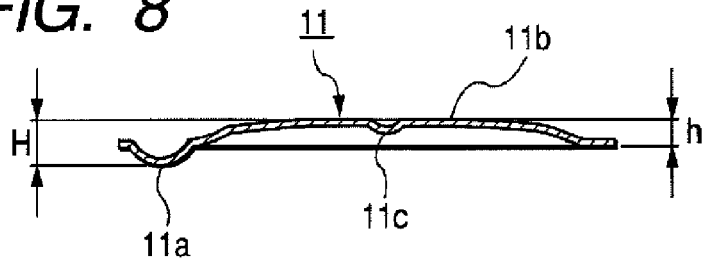
FIG. 8 is a sectional view taken along the line 8-8 in FIG. 7.
Figure 9:
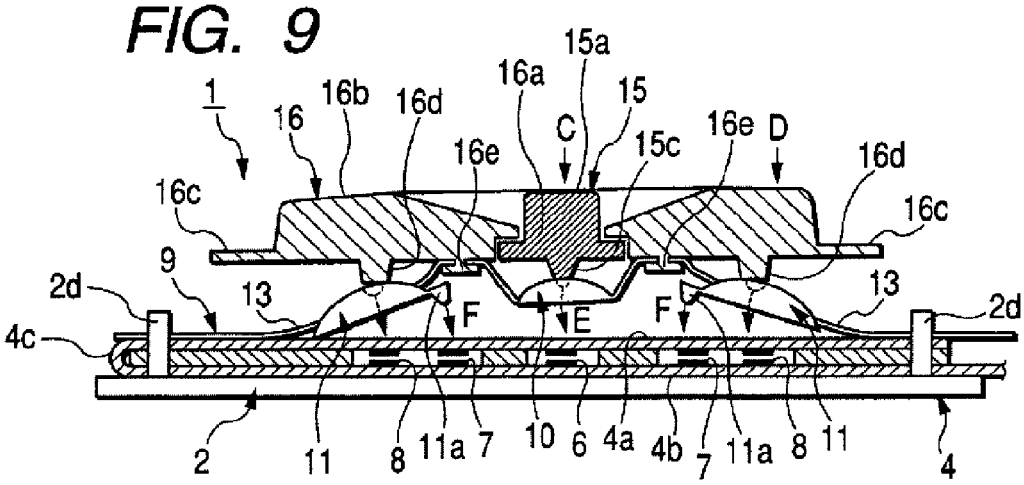
FIG. 9 is a schematic view illustrating a multi-directional input unit of the invention.
Figure 10:
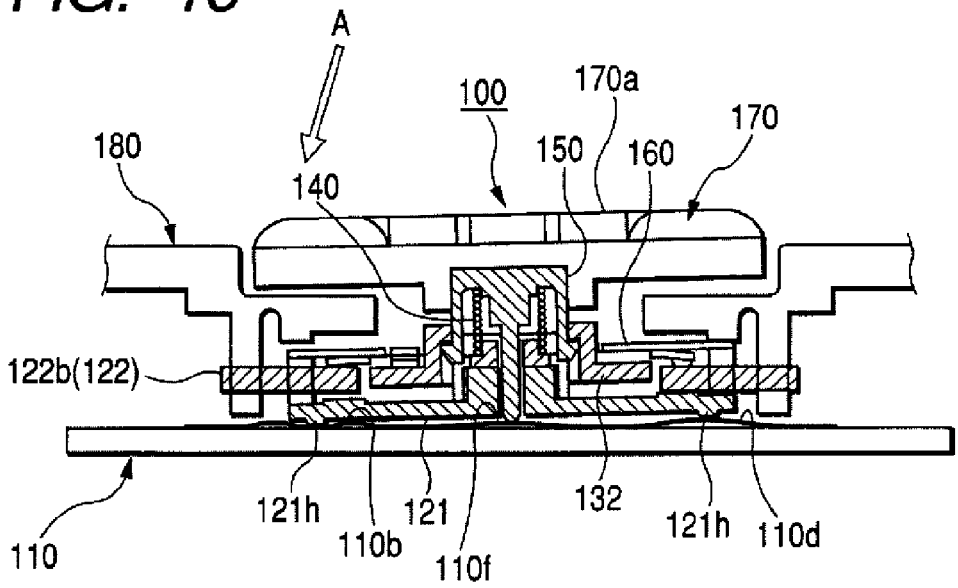
FIG. 10 is a sectional view of a main part of a multi-directional input unit in related art.
Figure 11:
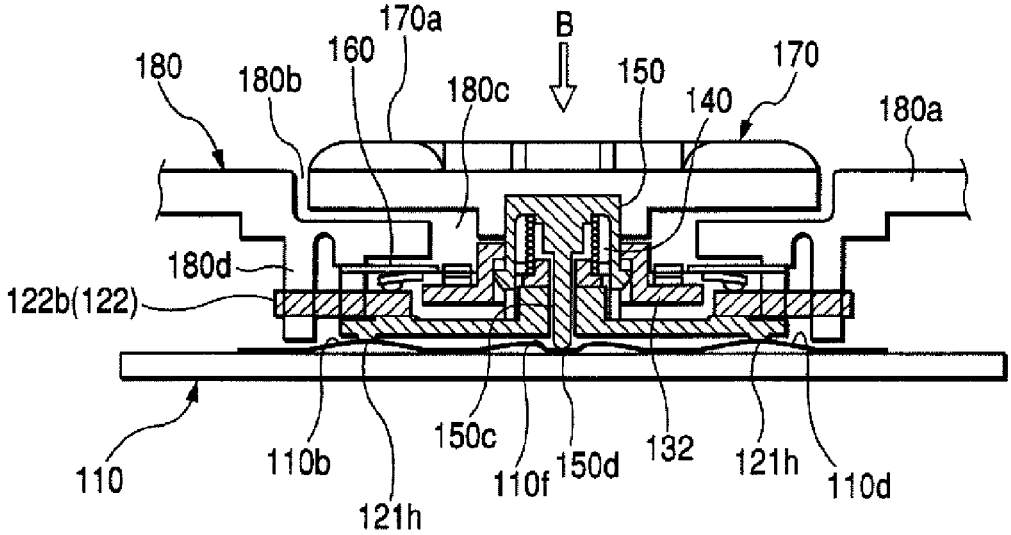
FIG. 11 is a sectional view of a main part of a multi-directional input unit in related art.

A multi-directional input unit is described with reference to drawings. FIG. 1 is a perspective view of a multi-directional input unit of the invention, FIG. 2 is a sectional view of a first keytop, FIG. 3 is a bottom view of a first keytop, FIG. 4 is a sectional view of a second keytop, FIG. 5 is a bottom view of a second keytop, FIG. 6 is a perspective view of an operating member, FIG. 7 is a top view of an operating member, FIG. 8 is a sectional view of 8-8 in FIG. 7, and FIG. 9 is a schematic view illustrating a multi-directional input unit of the invention.

In a multi-directional input unit 1, a fixing plate 2 formed of a metal plate, such as an iron plate having a thickness of 0.3 to 0.4 mm, and is disposed in a bottom portion of the unit. A circular membrane mounting portion 2*a* is formed in the fixing plate 2, and attachment arm portions 2*b* projecting from the membrane mounting portion 2*a* in four outward directions are formed. The attachment arm portions 2*b* are attached to an external electronic device (not shown).

A plurality of claw-shaped caulking portions 2*c* are formed in each of original parts of the attachment arm portions 2*b* so as to attach caulks to an attachment arm portion 4*e* of a membrane switch 3 and to an operating member 9. Positioning projections 2*d* of a predetermined height are formed between the claw-shaped caulking portions 2*c* so that the membrane switch 3 and positioning holes 4*f*, 9*c* are fitted in the positioning projections 2*d* of the operating member 9.

The membrane switch 3 is disposed on the membrane mounting portion 2*a*. As shown in FIG. 9 in the membrane switch, one sheet member 4 formed of a resin film is folded back whereby an upper sheet 4*a* and a lower sheet 4*b*, which are substantially circular shape, are formed to be mounted on the membrane mounting portion 2*a*. As shown in FIG. 1, terminal portions 4*d* are pulled from the lower sheet 4*b* and are connected to an external electronic device (not shown). The attachment arm portions 4*e* disposed in the attachment arm portions 2*b* of the fixing plate 2, and the positioning holes 4*f* fitted in the positioning projection 2*d* of the fixing plate 2, are formed in an overlapped portion 4*c* of the sheet member 4 in which the upper sheet 4*a* and the lower sheet are overlapped.

A spacer 5 having a predetermined thickness is interposed between the upper sheet 4*a* and the lower sheet 4*b*. The external shape of the spacer, as shown in FIG. 1, is similar to the shape of the upper sheet 4*a* and the lower sheet 4*b* of the sheet member 4, and the attachment arm portions 5*a* and the positioning holes 5*b* are formed in the four-direction positions.

In the center of the spacer 5, a first hole 5*c* having a predetermined diameter is formed. At the same distance from the first hole 5*c*, second holes 5*d* are formed between the first hole 5*c* and the positioning holes 5*b* in the four directions.

The second holes 5*d* in which holes are equal to the first hole 5*c* are overlapped out of line are in a shape of a gourd or oblong in shape.

Four third holes 5*e* equal in size to the first hole 5*c* are formed between the adjacent gourd-shaped second holes 5*d*, 5*d*. The second and third holes 5*d*, 5*e* are formed at the same respective distances in eight radial directions from the first hole 5*c*

The four third holes 5*e* are formed on the circumference in the inner holes of the second holes 5*d* from the first hole 5*c*.

The membrane switch 3, as shown in FIG. 9, is formed of a first switch portion 6 formed of an upper electrode and a lower electrode by printing and the like in the first hole 5*c* positioned in the center of the spacer 5, which is interposed between the upper and lower sheets 4*a*, 4*b*.

The membrane switch 3 is formed as second switch portion 7 in the internal gourd-shaped second hole 5*d* and a third switch portion 8 in the external second hole 5*d*. The inner peripheral second switch portion 7 is not illustrated, however, the second switch portions 7 are formed also in the four third holes 5*e*, whereby the second switch portions 6 are formed in the eight directions from the first switch portion 6.

That is, in the membrane switch, for example, the one first switch portion 6 in the first hole 5*c*, the eight second switch portion 7 in the second holes 5*d* and third holes 5*e*, and the four third switch 8 in the external second holes 5*d*, are formed respectively. Accordingly, the total thirteen switch portions are formed.

On the membrane switch 3, an operating member 9 is disposed having the same size as the upper sheet 4*a* of the membrane switch 3.

The operating member 9 is formed of one elastic metal plate having a thickness of 50 to 60 μm and is punched by a press working. As shown in FIGS. 6 and 7, in the operating member 9, a circular outer peripheral portion 9*a* is formed in a shape similar to the shape of the membrane switch 3.

Attachment arm portions 9*b* extended in four directions are formed from the outer peripheral portion 9*a*, and positioning holes 9*c* are formed therein, to which the positioning projections 3*d* of the fixing plate 2 are fitted.

In the operating member 9, a first operating portion 10 is formed. In a position opposite to the first switch 6 positioned in the center of the membrane switch 3, the first operating portion 10 is swelled in a dome shape by about 3 mm of a diameter In a crowning portion of a dome-shaped operating surface 10*a* of the first operating portion 10, a press portion 10*b* is projects downwardly. The first keytop 15 presses down on the crowning portion of the operating surface 10*a* with a predetermined pressing force, whereby the operating surface 10*a* is inverted and the press portion 10*b* presses down and contacts the first switch portion 6. Accordingly, the first input operation is performed.

When the first operating portion 10 is inverted, a click feeling is generated. An operator who presses down the below-described first keytop 15 feels the click feeling, and realizes that the first input operation has been performed.

In the operating member 9, four dome-shaped second operating portions 11 are formed in four positions opposite to the four gourd-shaped second holes 5*d*. They are formed at intervals of 90°, and a diameter of the second operating portion 11 is substantially equal to a diameter of the first operating portion 10.

Each of predetermined parts of the four second operating portions 11, as shown in FIGS. 6 and 7, is extended in a direction of the first operating portion 10 on the center from the dome-shaped outer peripheral portion. In the four second operating portions 11, a second operating portion 11*a* capable of operating the second switch portion (four portions) and a second press portion 11*c* capable of operating the third switch portion, are formed. A crowning portion of a dome-shaped operating surface 11*b* of the second operating portion 11 is projects downwardly.

In the second operating portion 11, as shown in FIG. 8, a height from the crowning portion of the operating surface 11*b* to the bottom of the second switch operating portion 11*a* has a height, H (0.3 to 0.35 mm), and a height of the dome-shaped operating surface 11*b* has a height, h (0.15 to 0.2 mm).

When an predetermined operating force (for example 160 g) is pressed on the crowning portion of the operating surface 11*b*, the second operating portion 11 is inverted whereby the same click feeling as generated by the first operating portion is produced.

In the operating member 9, dome-shaped third operating portions 12 similar to the second operating portion 11, are formed between the adjacent second operating portions 11, 11 and in four positions opposite to the third holes 5*e* of the membrane switch 3.

A second switch operating portion 12*a* is formed in each of the third operating portions 12. The second switch operating portion 12*a* operates the second switch portion 7 of parts (four parts) which the second switch operating portion 11*a* of the second operating portion 11 does not operate. The third operating portion 12 is extended in the direction of the first operating portion 10 on the center and the second switch operating portion 12*a* and has the same shape as the second switch operating portion 11*a* of the second operating portion 11. Further, a notch portion 12*b* is formed by notching a part of the circumference in the third operating portion 12 and a dome-shaped surface 12*c* is substantially D-cut.

Accordingly, the third operating portion 12 is inverted by the operating force, for example 80 g, lower than the second operating portion 11, whereby a click feeling is generated, which is weaker than the first and second operating portion 10, 11.

The second and third operating portion 11, 12 elastically urge the second keytop 16 to a predetermined position.

The third operating portion 12 is formed in the same height H, from the crowning of the dome-shaped operating surface 12*c* to the second switch operating portion 12*a*, as the second operating portion 11. Further, the height of the dome-shape operating surface 12*c* is the same as the height h of the second operating portion. Each of the first, second, and third operating portions 10, 11, and 12 is about 3 mm in a smaller diameter of the dome-shaped peripheral portion, and is connected to a plurality of connecting portions 13 formed in narrow widths. The connecting portions 13 are curved from the second and third operating portion 11, 12 to the first operating portion 10, whereby distances from the second and third operating portion 11, 12 to the first operating portion 10 are obtained. Accordingly, when the first operating portion 10 is elastically deformed, influences on the second and third operating portion 11, 12 may be decreased.

In the operating member 9, the plurality of connecting portions 13 are connected to the outer peripheral portion 9*a*, whereby each of the first, second, and third operating portions 10, 11, and 12 is formed in one body.

The plurality of connecting portions 13, as shown in FIG. 9, are swelled up or rounded having a predetermined height from the attachment arm portion 9*b*. Accordingly, when the attachment arm portions 9*b* of the operating member 9 are mounted on the membrane switch 3, each of the first, second, and third operating portion 10, 11, and 12 rise up from the membrane switch 3.

In this case, the inner peripheral second switch operating portion 11*a* and second switch operating portion 12*a* of the second and third operating portions 11, 12 are disposed further apart from the membrane switch 3 than outer peripheral side adjacent to the outer peripheral portion 9*a*.

In four places of the connecting portion 13 between the second and third operating portions 11, 12, fixing portions 14 formed of attachment holes in a predetermined diameter. That is, the fixing portions (attachment portion holes 14) for fixing a second keytop 16 are formed in the connecting portion 13 near by the second operating portions 11.

The operating member 9 is mounted on the membrane mounting portion 2*a* of the fixing plate 2 with each position of the attachment arm portions 9*b*, 4*e* adjusted, and the positioning projection 2*d* is fitted into each of the positioning holes 4*f*, 9*c*, thereby determining the position.

On the first operating portion 10 formed in the center of the operating member 9, as shown in FIGS. 2 and 3, a substantially circular first keytop 15 is disposed. The first keytop is formed of a resin material and includes a substantially trapezoidal press surface 15*a* and a blade portion 15*b* projected outside from the base portion of the trapezoidal press surface 15*a*. A convex portion 15*c* having a predetermined height and contacting the crown portion of the dome-shaped first operating portion 10, is projected in the center of bottom surface of the keytop 15, and four directions of the outer peripheral portion of the blade portion 15*b* are notched in a circular arc to form rotation stopping portions 15*d*.

The first keytop 15, as shown in FIG. 9, is fitted into a fitting hole 16*a* of a second keytop 16 and is not pulled out from the fitting hole 16*a*. Accordingly, the first keytop 15 may be pressed in a direction indicated by arrow C.

On the second and third operating portion 11, 12 of the operating member 9, as shown in FIGS. 4 and 5, a ring-shaped second keytop 16 having a circular fitting hole 16*a* is disposed. The first keytop is fitted into the fitting hole 16*a* on the center of the second keytop 16. The second keytop 16 is larger than the first keytop 15 in size. The second keytop 16 is formed of a resin material and has a ring-shaped operating surface 16*b*, and a blade portion 16*c* is formed in an outer peripheral side of the operating surface 16*b*. The blade portion 16*c* is supported by a chassis, such as an electronic device (not shown). Accordingly, the second keytop 16 is limited so as not to rise higher than a predetermined height.

On the bottom surface of the second keytop 16, as shown in FIG. 5, eight convex portions 16*d* in contact with the second and third operating portions 11, 12 are projected on a circumference, each having a predetermined diameter in eight directions and disposed at intervals of 45°. Further, on the bottom surface of the second keytop 16, four attachment projections 16*e* fitted to four attachment holes 14 of the operating member 9 in the plurality of convex portions 16*d* are formed and rotation stopping projections 16*f* are formed in four positions abutted to the attachment hole 16*a*.

The attachment projections 16*f* are fitted to the attachment holes 14 as the fixing portion of the operating member 9, and the attachment projections 16*f* are treated by a heat-caulking, whereby the operating member 9 and the second keytop 16 are integrated. The first operating portion 10 of the operating member 9 elastically urges the first keytop 15 to a predetermined height.

In the operating member 9, the connecting portion 13 with the attachment holes 14 is attached to the attachment projections of the second keytop 16, whereby the crown portions of the operating surfaces 11*b*, 12*c* of the second and third operating portions 11, 12 elastically abut the convex portions 16*d* formed in the eight portions of the second keytop 16.

When, the domed-shaped operating surface 15*a* of the first keytop 15 is fitted to the attachment hole 16*a* of the second keytop 16, the rotation stopping portions 15*d* engage the rotation stopping projections 16*f*. Accordingly, the first keytop 15 is not rotated with respective to the second keytop 16 and is not pulled out from the attachment hole 16*a* by the blade portion 15*b*.

The operating surface 15*a* of the first keytop 15 and the operating surface 16*b* of the second keytop 16 are positioned on the same plane.

When the attachment holes 14 of the operating member 9 are fitted to the attachment projections 16*e* of the second keytop 16 while the first keytop 15 is fitted to the fitting hole 16*a*, and the attachment projections 16*e* are treated by a heat-caulking, the second keytop 16 to which the first keytop 15 is attached and the operating member 9 are integrated, as shown in FIG. 9.

While the attachment arm portions 9*b* of the operating member 9 are matched to the attachment arm portions 4*e* of the membrane switch 3, each of the positioning holes 4*f*, 9*c* is fitted to the positioning projection 2*d* whereby the fixing plate 2, the membrane switch 3, and the operating member 9 are positioned.

When the caulking is attached as well as the claw-shaped caulking portions 2*c* are folded inside, movement of the membrane switch 3 and the operating member 9 is limited.

Thus, the second keytop 16 is elastically held at a predetermined height from the fixing plate 2 due to urging force of the connecting portion 13 of the operating member 9, and the first keytop 15 is elastically urged in an upper direction opposite to a direction indicated by arrow C, shown in FIG. 9, whereby each of the operating surfaces 15*a*, 16*b* is at an initial state at substantially same height. Accordingly, a multi-directional input unit 1 is assembled.

Since the blade portion 16*c* is supported to a chassis (not shown) such as an electronic device, movement of the second keytop 16 is limited so that the second key does not rise up over a predetermined-height position.

Operation of the multi-directional input unit 1, assembled above, according to an aspect of the invention is described with reference to FIG. 9. First, an operating force (about 160 g) is applied on the operating surface 15*a* of the first keytop 15 in an initial state such that the operating surface 15*a* rises in a predetermined height from the attachment hole 16*a* of the second keytop 16, whereby the first keytop is pressed in the direction indicated by arrow C.

Then, the first operating portion 10 engages the membrane switch 3 in against the urging force of the connecting portion 13 supported by the attachment projection 16*e*, and the dome-shaped operating surface 10*a* pressed by the convex portion 15*c* is inverted. Accordingly, the press portion 10*b* presses down the first switch portion 6 of the membrane switch 3 whereby the first input operation is performed and a click feeling is generated. Therefore, the operator recognizes that the first input operation have been performed.

Subsequently, when the operating force applied to the first keytop 15 released, the first keytop 15 elastically urged by the first operating portion 10 rises up whereby the first keytop 15 is automatically restored in the initial state.

Next, when an operating force (i.e. 80 g) weaker than the operating force applied to the first keytop 15 is applied on the operating surface 16*b* of the second keytop 16 in the initial state by fingers of the operator, as indicated by arrow D, the second operating portion 11 or the third operating portion 12 resists the urging force thereof, and engages the membrane switch 3. Accordingly, the second switch operating portion 11*a* or the second switch operating portion 12*a* presses down one of the eight the second switch portions 7 to perform the second input operation.

In addition, when the finger of the operator applying the small operating force to the second keytop 16 is slid in the circumferential direction, the eight second switch portions 7 are operated by turns whereby the eight-direction inputs can be performed.

Next, after the second input operation, a greater operating force (i.e. 160 g) is applied to the operating surface 16*b* of the second keytop 16 in a position opposite to the third switch portion 8. Thus, the dome-shaped operating portion 11 positioned on the third switch portion 8 is inverted, whereby the second press portion 11*c* of the second operating portion 11 press down the third switch portion 8. Accordingly, the third input operation is performed.

That is, in the multi-directional input unit 1 according to an aspect of the invention, the first keytop 15 can go up and come down independently from the second keytop 16, a predetermined operating force is applied to the first keytop 15 whereby the first input operation can be performed, and two different operating forces are applied to the second keytop 16 whereby different second and third input operations can be performed.

In addition, in the embodiment of the invention, it is described that the operating member 9 is fixed to the second keytop 16. Herein, the operating member 9 is fixed to the second keytop 16 so that the second keytop 16 may be elastically urged in the upper direction.

Further, the membrane switch 3, the operating member 9, and the first and second keytops 15, 16 are not limited to circular shapes. However, for example, they may be rectangular in shape.

In the embodiment of the invention, it is described that the attachment hole 15 of the operating member 9 is attached to the attachment projection 16*e* of the second keytop 16 by the caulking. However, they may be attached by an adhesive.

According to a multi-directional input unit of the invention, a first operating portion elastically urging the first keytop is formed in the operating member and a plurality of second operating portions elastically urging the second keytop is integrally formed in an outer peripheral side of the first operating portion. Some portions of an outer peripheral portion of the operating member are mounted on a fixing plate, and the first or second operating portion is fixed on any one of the first and second keytops. The first and second keytops are elastically urged to a predetermined height from the fixing plate, and any one of the dome-shaped first and second operating portions is inverted whereby the switch portion is operated when any one of the first and second keytops is pressed down. Accordingly, a click feeling is obtained, whereby it is possible to recognize a reliable input of the switch portion.

A plurality of elastically deformable connecting portions which connect the first and second operating portions are formed in the operating member, and the first and second keytops are elastically urged by the first and second operating portions so as to be at a predetermined height. Accordingly, each of the first and second keytops is operated independently, whereby the switch portion can be prevented from an erroneous input.

A fixing portion for fixing on the second keytop is formed in the connecting portions nearby the second operating potion, and the fixing portion is fixed on the second keytop. Accordingly, movement of the second keytop can be free in upper and lower directions, and can be limited in left and right directions.

An operating surface of the first keytop is inserted into a fitting hole formed in the center of the second keytop whereby the first keytop is not pulled out and the operating surface of the first keytop is elastically urged to the same height as an operating surface of the second keytop by the first operating portion of the operating member in which the fixing portion is fixed on the second keytop. Accordingly, operation of the first and second keytops is superior.

Convex portions for pressing down the dome-shaped operating surfaces of the first and second operating members are projected at a predetermined height in the first and second keytops. Accordingly, the first and second operating portions are inverted by pressing the first and second keytops, whereby a reliable click feeling can be produced.

The fixing portion includes an attachment hole formed in a part of the connecting portion and wherein an attachment projection which is fitted into the fitting hole. Caulking is attached to the attachment projection so that the operating member can be integrated with the second keytop, whereby the assembly is easy.

The connecting portion is curved from the fixing portion to the first and second operating portion. Accordingly, since a distance from the fixing portion to the first and second operating portion can be obtained, an influence on the second operating portion can decease even if the first operating portion is elastically deformed by pressing the first keytop.

The operating member is formed of an elastic metal plate and the fixing plate is formed of a rigid metal plate. An outer peripheral portion, which connects the plurality of connecting portions and attachment arm portion extended from the outer peripheral portion to the outside, is formed in the operating member, and the attachment arm portion is attached on the fixing plate, whereby a movement of the operating member of parts, except for the first and second operating portion and the connecting portion, is limited. Accordingly, movement of the operating member is limited in left and right directions so that movement of the first and second keytops can be limited in left and right directions.

A positioning projection for positioning the membrane switch and the operating member, and a caulking portion to which the attachment arm of the operating member formed of a metal plate, is attached by a caulking. The caulking is attached to the operating member in the caulking portion so that the membrane switch is covered with the operating member. Accordingly, damage to a semiconductor or other electronic device can be prevented should static electricity be inadvertently generated by the operator.

The first keytop in the operating member can go up and come down independently from the second keytop, and a predetermined operating force is applied to the first keytop whereby the first input operation can be performed, and two different operating forces are applied to the second keytop 16. Accordingly, each of the first and second switch portions is independently and reliably operated, whereby a highly efficient multi-directional input unit can be provided.

In the membrane switch, a first switch portion is formed in a position opposite to the first operating portion, second switch portion is formed in positions opposite to the second operating portion at intervals of 45° in a radial direction, and third switch portions are formed at a predetermined intervals from the second switch portion positioned at intervals of 90°. Accordingly, the different second and third input operations can operate the second and third switch portions, whereby it is possible to be inputted without increase in the number of components.

The second operating portion, which operates the second, and third switch portions positioned at intervals of 90° are formed in a position opposite to the third switch portion. A third operating portion is formed between the second operating portions adjacent each other and the third operating portion operates the second switch portion which the second operating portion dose not operate. Accordingly, different second and third input operations can be performed in the second operating portion.

The first keytop is pressed down and the first operating portion is inverted so that a first input operation of the first switch portion is performed, a predetermined press is applied to the second keytop so that a second input operation of the second switch portion is performed through the second and third operating portion, and a press greater than the predetermined pressure is applied to the second keytop and the dome-shaped second operating portion is inverted so that a third input operation of the second switch portion is performed. Accordingly, two types of input operations can be performed by two-stage operation of which operating forces are different than each other.

Each of the first, second, and third operating portions is connected to the narrow-width connecting portion and is integrated so that the operating member elastically urges the first and second keytops to the predetermined height. Accordingly, because the number of the components is reduced, assembly is simplified.

A part of the dome-shaped outer peripheral portion of the third operating portion is notched so that the click generated in the third operating portion is weaker than the click generated in the second operating portion. Accordingly, a click generated by pressing down the second operating portion can be accurately felt, whereby the input of the third switch portion can be reliably recognized.

Second switch operating portions, which extend from the dome-shaped outer peripheral portion and operate the second switch portion, are formed in the second and third operating portions respectively, and wherein third switch operating portion, which is projected from a dome-shaped crowning portion to the inside and operates the third switch portion, is formed in the second operating portion. Accordingly, the second and third switch portions can be accurately operated.

A convex portion, which presses down the first operating portion is formed in the first keytop, and a plurality of convex portions which press down the second and third operating portions are formed in the second keytop. Accordingly, by pressing down the first and second keytops, the first, second, and third operating portions can be reliably pressed and inverted.

What is claimed is:

1. A multi-directional input unit comprising: a first keytop held at a predetermined height;

a ring-shaped second keytop held at the same height as the first keytop so as to surround an outside portion of the first keytop;

an operating member elastically urging the first and second keytops to the predetermined height; and a membrane switch having a plurality of switch portions operated by the operating member on a side opposite the first and second keytops, wherein a first operating portion elastically urging the first keytop is formed in the operating member, and a plurality of second operating portions elastically urging the second keytop are integrally formed in an outer peripheral side of the first operating portion, wherein portions of an outer peripheral portion of the operating member are mounted on a fixing plate, the first or second operating portions fixed on either the first or second keytops, the first and second keytops are elastically urged to the predetermined height from the fixing plate, and either the dome-shaped first and second operating portions are inverted, whereby the switch portion is operated when the first or the second keytops are pressed down, wherein a plurality of elastically deformable connecting portions, which connect the first and second operating portions, are formed in the operating member, and the first and second keytops are elastically urged by the first and second operating portions so as to be to the predetermined height.

2. The multi-directional input unit according to claim 1, wherein a fixing portion for fixing on the second keytop is formed in the connecting portions nearby the second operating portion, and the fixing portion is fixed on the second keytop.

3. The multi-directional input unit according to claim 2, wherein an operating surface of the first keytop is inserted into a fitting hole formed in the center of the second keytop, whereby the first keytop is not pulled out and the operating surface of the first keytop is elastically urged to the same height as an operating surface of the second keytop by the first operating portion of the operating member.

4. The multi-directional input unit according to claim 1, wherein convex portions for pressing down the dome-shaped operating surfaces of the first and second operating members are projected in a predetermined height in the first and second keytops.

5. The multi-directional input unit according to claim 2, wherein the fixing portion includes an attachment hole formed in a part of the connecting portion and wherein an attachment projection which is fitted into the fitting hole and is capable of receiving caulking.

6. The multi-directional input unit according to claim 2, wherein the connecting portion is curved from the fixing portion to the first and second operating portion.

7. The multi-directional input unit according to claim 1, wherein the operating member is formed of an elastic metal plate, the fixing plate is formed of a rigid metal plate, an outer peripheral portion, which connects the plurality of connecting portions and attachment arm portion extended from the outer peripheral portion to the outside, are formed in the operating member, and the attachment arm portion is attached on the fixing plate whereby a movement of the operating member of parts except for the first and second operating portion and the connecting portion is limited.

8. The multi-directional input unit according to claim 7, wherein a positioning projection for positioning the membrane switch and the operating member and a caulking portion to which the attachment arm of the operating member formed of a metal plate is attached by a caulking are formed.

9. The multi-directional input unit according to claim 1, wherein the second keytop is responsive to two different operating forces, whereby the second keytop having first and second input operations different from each other is operated.

10. The multi-directional input unit according to claim 9, wherein, in the membrane switch, a first switch portion is formed in a position opposite to the first operating portion, second switch portion is formed in positions opposite to the second operating portion at intervals of 45.degree. in a radial, and third switch portions are formed at a predetermined interval from the second switch portion positioned at intervals of 90.degree.

11. The multi-directional input unit according to claim 10, wherein the second operating portion which operates the second and third switch portions positioned at intervals of 90.degree. is formed in a position opposite to the third switch portion, a third operating portion is formed between the second operating portions adjacent each other, and the third operating portion operates the second switch portion which the second operating portion does not operate.

12. The multi-directional input unit according to claim 11, wherein the first keytop is pressed down and the first operating portion is inverted so that a first input operation of the first switch portion is performed, a predetermined pressure is applied to the second keytop so that a second input operation of the second switch portion is performed through the second and third operating portion, and a pressure greater than the predetermined pressure is applied to the second keytop, and the dome-shaped second operating portion is inverted so that a third input operation of the second switch portion is performed.

13. The multi-directional input unit according to claim 11, wherein each of the first, second, and third operating portions is connected to the narrow-width connecting portion and is integrated so that the operating member elastically urges the first and second keytops to the height for rising.

14. The multi-directional input unit according to claim 11, wherein a part of the dome-shaped outer peripheral portion of the third operating portion is notched so that the click generated by the third operating portion is weaker than the click generated by the second operating portion.

15. The multi-directional input unit according to claim 11, wherein second switch operating portions, which extend from the dome-shaped outer peripheral portion and operate the second switch portion, are formed in the second and third operating portions respectively and wherein third switch operating portion, which project from a dome-shaped crowning portion to an inside portion and operates the third switch portion, is formed in the second operating portion.

16. The multi-directional input unit according to claim 11, wherein a convex portion which presses down the first operating portion is formed in the first keytop and a plurality of convex portions which press down the second and third operating portions are formed in the second keytop.

* * * * *